US010875557B2

(12) United States Patent
Braband et al.

(10) Patent No.: US 10,875,557 B2
(45) Date of Patent: Dec. 29, 2020

(54) METHOD AND SYSTEM FOR DETECTING OBSTACLES IN A HAZARDOUS AREA IN FRONT OF A RAIL VEHICLE

(71) Applicant: SIEMENS AKTIENGESELLSCHAFT, Munich (DE)

(72) Inventors: Jens Braband, Braunschweig (DE); Bernhard Evers, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 137 days.

(21) Appl. No.: 16/088,864

(22) PCT Filed: Mar. 1, 2017

(86) PCT No.: PCT/EP2017/054758
§ 371 (c)(1),
(2) Date: Sep. 27, 2018

(87) PCT Pub. No.: WO2017/167529
PCT Pub. Date: Oct. 5, 2017

(65) Prior Publication Data

US 2019/0126958 A1 May 2, 2019

(30) Foreign Application Priority Data

Mar. 31, 2016 (DE) ..... 10 2016 205 330

(51) Int. Cl.
*B61L 23/04* (2006.01)

(52) U.S. Cl.
CPC ..... *B61L 23/041* (2013.01)

(58) Field of Classification Search
CPC ..... B61L 23/041
USPC ..... 701/301
See application file for complete search history.

(56) References Cited

U.S. PATENT DOCUMENTS 6,129,025 A * 10/2000 Minakami ..... B60L 50/51 104/88.01

FOREIGN PATENT DOCUMENTS

| | | | |
|---|---|---|---|
| CN | 102092048 | A | 6/2011 |
| CN | 104331910 | A | 2/2015 |
| CN | 104442924 | A | 3/2015 |
| DE | 19842827 | A1 | 3/2000 |
| WO | 03019233 | A1 | 3/2003 |
| WO | 2015015494 | A1 | 2/2015 |

* cited by examiner

*Primary Examiner* — Gertrude Arthur Jeanglaude
(74) *Attorney, Agent, or Firm* — Laurence Greenberg; Werner Stemer; Ralph Locher

(57) ABSTRACT

A method for detecting obstacles in a hazardous area in front of a rail vehicle uses an obstacle detection arrangement to detect the obstacles in the hazardous area in front of the rail vehicle. In order to permit improved autonomous driving of the rail vehicle, a target value is determined for a value which characterizes the performance of the obstacle detection arrangement. A system for detecting obstacles in a hazardous area in front of a rail vehicle is also provided.

12 Claims, 2 Drawing Sheets

METHOD AND SYSTEM FOR DETECTING OBSTACLES IN A HAZARDOUS AREA IN FRONT OF A RAIL VEHICLE

BACKGROUND OF THE INVENTION

Field of the Invention

A locomotive driver of a rail vehicle must, e.g. according to Regulation 408.2341 of Deutsche Bahn AG, observe the track being traveled, signals, railway crossings and the overhead line.

However, the maximum permissible running speed of a rail vehicle is not currently dependent on the actual observation capability of the locomotive driver. For example, even in poor visibility, a high-speed train (e.g. an ICE) is allowed to run at a speed which would not prevent collision with an obstacle in the hazardous area of the track if the brakes were triggered after sighting the obstacle.

In the case of automatic running without a locomotive driver (or when running without track observation by a locomotive driver), track observation must be made possible by means of technical equipment.

The invention relates to a method in which an obstacle detection arrangement is used to detect obstacles in a hazardous area in front of the rail vehicle.

The invention also relates to a system in which an obstacle detection arrangement is suitably embodied to detect obstacles in a hazardous area in front of the rail vehicle.

Such a method and such a system are known from the German patent application 102015212019.8.

SUMMARY OF THE INVENTION

The object of the invention is to specify a method and a system of a generic type, which allow improved autonomous running of the rail vehicle or rail vehicles.

This object is achieved by a method having the features described below, in which a target value is determined for a variable that characterizes the performance of the obstacle detection arrangement.

The object is also solved correspondingly by a system having the features described below, which is suitably embodied to determine a target value for a variable that characterizes the performance of the obstacle detection arrangement.

In particular, the inventive method and the inventive system have the advantage that operational and environmental limiting conditions can be defined and their transformation can be realized by determining the target value as a specification for the performance of the obstacle detection arrangement during the track observation, said specification being dynamically adapted to the given circumstances of the track and being at least as good as the performance of a locomotive driver under the same limiting conditions in this case.

In accordance with the method, it is considered advantageous to determine an actual value of the variable that characterizes the performance of the obstacle detection arrangement. A control signal for adapting a driving strategy of the rail vehicle is preferably then generated as a function of the deviation of the actual value from the target value.

In accordance with the system, it is considered advantageous correspondingly for the system to be suitably embodied to determine an actual value of the variable that characterizes the performance of the obstacle detection arrangement. The system is preferably then suitably embodied to generate a control signal for adapting a driving strategy of the rail vehicle as a function of the deviation of the actual value from the target value.

In accordance with the method, it is also considered advantageous to provide a value corresponding to the currently existing technical visibility distance of the obstacle detection arrangement as an actual value, and a value corresponding to the currently required technical visibility distance for obstacle detection as a target value. Alternatively or additionally, a value corresponding to the currently existing technical resolution of the obstacle detection arrangement can be provided as an actual value, and a value corresponding to the currently required technical resolution for obstacle detection can be provided as a target value.

In accordance with the system, it is considered advantageous correspondingly for the system to be suitably embodied to provide a value corresponding to the currently existing technical visibility distance of the obstacle detection arrangement as an actual value, and a value corresponding to the currently required technical visibility distance for obstacle detection as a target value. And alternatively or additionally, the system can be suitably embodied to provide a value corresponding to the currently existing technical resolution of the obstacle detection arrangement as an actual value, and a value corresponding to the currently required technical resolution for obstacle detection as a target value.

In accordance with the method, an on-board obstacle detection arrangement is used as an obstacle detection arrangement. The obstacle detection arrangement of the inventive system is therefore preferably an on-board obstacle detection arrangement.

In accordance with the method, it is moreover considered advantageous for the target value to be determined as a function of information relating to the current braking distance of the rail vehicle and as a function of information relating to the given environmental visibility distance at the current location of the rail vehicle and/or information relating to the given topological visibility distance at the current location of the rail vehicle.

It is therefore advantageous for the system to be suitably embodied to determine the target value as a function of information relating to the current braking distance of the rail vehicle and as a function of information relating to the given environmental visibility distance at the current location of the rail vehicle and/or information relating to the given topological visibility distance at the current location of the rail vehicle.

The actual value is preferably determined as a function of information relating to the type of the obstacle detection device. The system is therefore preferably suitably embodied to determine the actual value as a function of information relating to the type of the obstacle detection device.

BRIEF DESCRIPTION OF THE SEVERAL VIEWS OF THE DRAWING

The invention is explained in greater detail below with reference to figures, in which.

DESCRIPTION OF THE INVENTION

Figure 1:
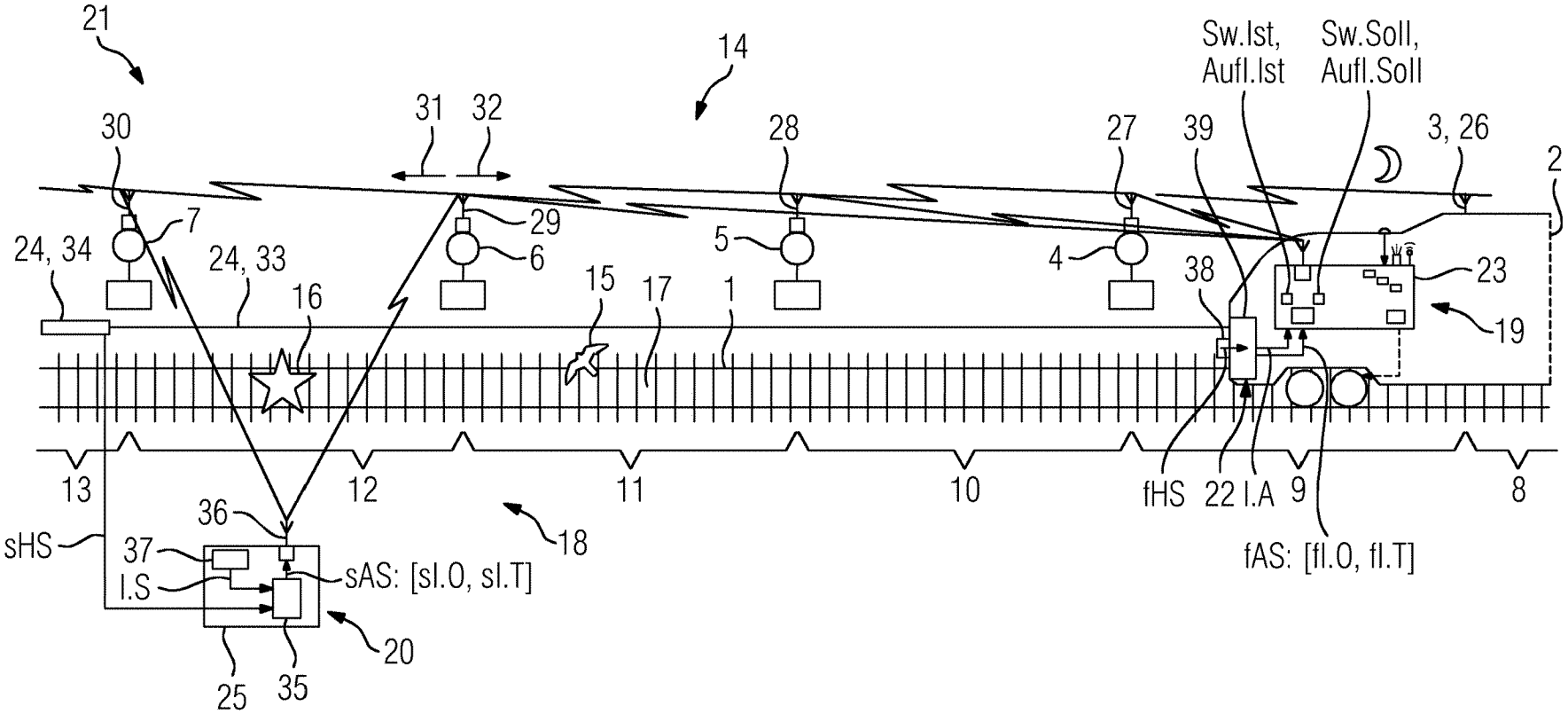
FIG. 1 shows a rail vehicle on a track and a system according to the invention for detecting obstacles in a hazardous area of the track in front of the rail vehicle.
Figure 2:
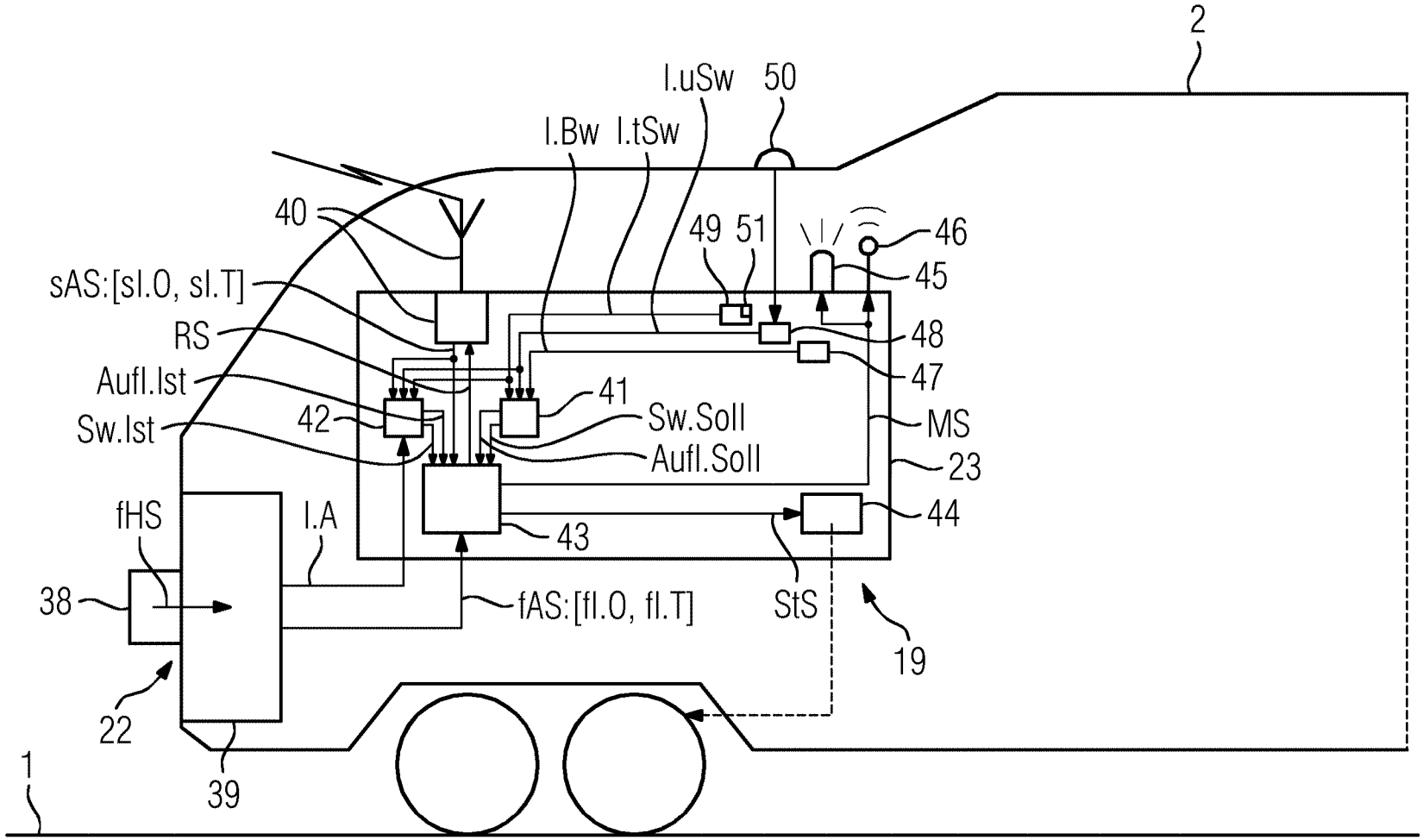
FIG. 2 shows the rail vehicle as per FIG. 1.

FIG. 1 shows a track 1 with a rail vehicle 2, this being in particular a rail vehicle which runs automatically without a locomotive driver.

The track 1 is equipped with signals 3, 4, 5, 6, 7, these taking the form of light signals here, wherein the signals delimit track sections 8, 9, 10, 11, 12, 13 of the track.

Furthermore, FIG. 1 shows a preferred embodiment variant 14 of the inventive system for detecting obstacles 15, 16 in a hazardous area 17 of the track in front of the rail vehicle.

The system 14 comprises trackside equipment 18 (track equipment) and on-board equipment 19 (vehicle equipment). The track equipment 18 comprises a trackside obstacle detection arrangement 20 and a trackside transmission arrangement 21. The vehicle equipment 19 comprises an on-board obstacle detection arrangement 22 and a vehicle control arrangement 23.

The trackside obstacle detection arrangement 20 is an arrangement which scans the track 1 continuously in order to detect obstacles, and comprises a trackside sensor device 24 and a trackside evaluation device 25.

The trackside transmission arrangement 21 comprises communication units 26, 27, 28, 29, 30 and possibly repeaters (not shown here).

The communication units 26, 27, 28, 29, 30 are attached to the signals 3, 4, 5, 6, 7. In the preferred embodiment variant 14 of the inventive system shown here, use is made of known communication units based on Car2X technology, which operate in the 5.9 GHz range. The communication units 26, 27, 28, 29, 30 are able to send and receive in both directions 31, 32 of the track. The sending and receiving can take place in a non-interacting manner. The sending and receiving, e.g. by means of feeding in the signal current of the signals 3, 4, 5, 6, 7 or a current that is generated by solar modules, can also be effected autonomously in respect of energy.

Where there is no direct connection between the communication units 26, 27, 28, 29, 30 attached to the signals, repeaters are installed or other media are used in order to ensure that the communication units 26, 27, 28, 29, 30 making up the transmission arrangement 21 are connected for signaling purposes.

In the illustrated embodiment variant 14 of the inventive system, by way of example, a so-called "Fiber Optic Distributed Sensor Technique" and in particular a "Distributed Acoustic Sensor Technique" is used as a trackside obstacle detection arrangement 20. Alternatively or additionally, it is also possible to use other trackside obstacle detection arrangements or hybrid arrangements comprising various trackside obstacle detection arrangements.

The sensor device 24 comprises an optical fiber bus 33, this being installed along the track 1 in the hazardous area 17, and a send/receive unit 34 which is attached thereto. Signals received by the send/receive unit 34 are transferred to the evaluation device 25 as trackside obstacle signals sHS.

The trackside evaluation device 25 is equipped with an evaluation unit 35, a communication unit 36 and a track map unit 37, said track map unit 37 having a rudimentary map of the track.

The trackside obstacle signals sHS are evaluated by means of filter algorithms in the evaluation unit 35.

If an obstacle (an event) is detected by the evaluation unit 35 of the trackside obstacle detection arrangement, it is classified by the evaluation unit 35. The type of obstacle is determined by means of pattern recognition in this case. Different reactions are triggered depending on the type. In addition, with reference to information I.S relating to the track sections and the signals delimiting the track sections, said information being read out from the track map unit 36 by the evaluation unit 34, one of the obstacles (events) in each case is assigned to the track section concerned. If the respective obstacle (event) is relevant, the evaluation unit 35 emits a trackside evaluation signal sAS:[sI.O, sI.T] via the communication unit 36. The evaluation signal sAS:[sI.O, sI.T] is reported to those communication units 29, 30 of the trackside communication arrangement which are attached to the signals 6, 7 that delimit the track section 12 in which the relevant obstacle (event) 16 was detected.

Concerning the bird 15 shown above the track section 12, which the trackside obstacle detection arrangement detects as such, the evaluation unit 35 does not output an evaluation signal because it classifies the bird as an obstacle of a non-relevant type. With regard to the obstacle designated 16, the evaluation unit outputs the evaluation signal sAS:[sI.O, sI.T] because it classifies this as an obstacle of a relevant type.

The communication units 26, 27, 28, 29, 30 attached to the signals are mutually coordinated, such that the communication unit of each signal has knowledge of the events in both directions 31, 32 within a distance of approximately 3 km.

The trackside sensor device 24 therefore detects a particular obstacle 15 or 16 of the obstacles 15, 16 and outputs a trackside obstacle signal sHS indicating the particular obstacle 15 or 16 respectively to the evaluation device 25. The evaluation device 25 then generates the trackside evaluation signal sAS:[sI.O, sI.T] from the trackside obstacle signal sHS, and outputs it by means of its communication unit 36 to the trackside transmission arrangement 21 for transmission to the rail vehicle 2.

In this case, trackside information sI.T relating to the type of the relevant obstacle 16 and trackside information sI.O relating to the location of the relevant obstacle 16 is provided on the basis of the trackside evaluation signal sAS:[sI.O, sI.T].

The rail vehicle 2 approaching a signal designated 4 here receives the information for the next three sections 10, 11, 12 which is relevant for the rail vehicle. An extract from the track map can also be transmitted with said information if necessary. In the same way, events which have been resolved can be withdrawn.

The on-board obstacle detection arrangement 22 comprises an on-board sensor device 38 and an on-board evaluation device 39.

The vehicle control arrangement 23 has a communication unit 40 which is suitably embodied to receive the trackside evaluation signal sAS:[sI.O, sI.T] from the trackside transmission arrangement 21.

The vehicle control arrangement 23 also has a target value determination device 41, an actual value determination device 42 and a control device 43.

The vehicle control arrangement 23 also has a running control device 44 in the form of a propulsion and brake control device, a warning device 45 (here in the form of a hooter) and an alerting device 46 (here in the form of a means for alerting a maintenance gang).

In addition, the vehicle control arrangement 23 comprises a device 47 for outputting information I.Bw relating to the current braking distance of the rail vehicle, a device 48 for outputting information I.uSw relating to the given environmental visibility distance at the current location of the rail vehicle, and a device 49 for outputting information I.tSw relating to the given topological visibility distance at the current location of the rail vehicle. The environmental visibility distance may be limited by fog or darkness, for example. The topological visibility distance may be limited by curves or gradients, for example.

The device 48 is connected to a brightness sensor 50, for example. The device 49 has access to a track atlas 51, which comprises a component describing the topology of the track.

When approaching the obstacle 16, reactions of the rail vehicle 2 are derived in each case from a variable which characterizes the performance of the on-board obstacle detection arrangement 22, as a function of the evaluation signal sAS:[sI.O, sI.T] of the trackside obstacle detection arrangement 20 and as a function of at least one of the actual values designated Sw.Ist and AufI.Ist here.

One of the derived reactions consists in the control device 43 determining a control signal StS for adapting a driving strategy of the rail vehicle 2 and outputting said control signal to the running control device 44, which then adapts the driving strategy of the rail vehicle to the control signal StS accordingly.

A further reaction consists in the control device 43 determining a report signal MS and outputting this to the warning device 45 and the alerting device 46.

The control device 43 generates the control signal StS as a function of a range of values and information.

This means that for the purpose of automatic running without a locomotive driver, in addition to the at least one actual value Sw.Ist or AufI.Ist, an assigned target value Sw.SoII or AufI.SoII of the at least one variable which characterizes the performance of the on-board obstacle detection arrangement is also output to the control device 43. Alternatively, it is also possible for both actual values and both target values to be output to the control device 43.

The control device 43 then determines the deviation A.Sw=Sw.Ist-Sw.SoII and/or the deviation A.AusI=AusI.Ist-AusI.SoII of the respective actual value from the assigned target value, such that the reactions (i.e. the control signal StS and the report signal MS) are derived as a function of the trackside evaluation signal sAS:[sI.O, sI.T] and as a function of the calculated deviation A.Sw and/or the calculated deviation A.AusI.

Moreover, the control device 43 also determines the control signal StS as a function of the trackside information sI.T relating to the type of the obstacle 16 and as a function of the trackside information sI.O relating to the location of the obstacle 16.

The control device 43 also generates the control signal StS as a function of an on-board evaluation signal fAS:[fI.O, fI.T]. In order to achieve this, the sensor device 38 of the on-board obstacle detection arrangement 22, as soon as it detects the obstacle 16, generates an on-board obstacle signal fHS indicating the obstacle 16 and outputs this to the evaluation device 39. From the on-board obstacle signal fHS, the evaluation device 39 in turn generates the on-board evaluation signal fAS:[fI.O, fI.T] and outputs this to the control device 43. The on-board evaluation device 39 also outputs information I.A relating to the type of the obstacle detection arrangement 22.

In particular, a value Sw.Ist corresponding to the currently existing technical visibility distance (i.e. to the currently existing sensory range) of the obstacle detection arrangement 22 is determined as an actual value by the actual value determination device 42, and a value Sw.SoII corresponding to the currently required technical visibility distance for obstacle detection (i.e. to the currently required sensory range for obstacle detection) is provided as a target value by the target value determination device 41 correspondingly.

Alternatively or additionally, a value AufI.Ist corresponding to the currently existing technical resolution of the obstacle detection arrangement 22 is determined as an actual value by the actual value determination device, and a value AufI.SoII corresponding to the currently required technical resolution for obstacle detection is provided as a target value by the target value determination device 41 correspondingly.

In particular the value Sw.Ist of the currently existing technical visibility distance is determined by the actual value determination device as a function of the information I.A relating to the type of the obstacle detection device 22, the trackside information sI.T relating to the type of the obstacle 16, the information I.uSw relating to the given environmental visibility distance at the current location of the rail vehicle 2 and the information I.tSw relating to the given topological visibility distance at the current location of the rail vehicle, and output to the control device 43.

The value Sw.SoII of the currently required technical visibility distance is determined by the target value determination device preferably as a function of the information I.Bw relating to the current braking distance of the rail vehicle, the information I.uSw relating to the given environmental visibility distance at the current location of the rail vehicle and the information I.tSw relating to the given topological visibility distance at the current location of the rail vehicle, and output to the control device 43.

In this case, the value Sw.SoII represents the current location-related minimum of the required technical visibility distance for obstacle detection and is used as a specification for the currently existing technical visibility distance of the on-board obstacle detection arrangement and its sensor device (sensor technology in the form of e.g. a radar system, a camera system, etc.) for the purpose of track observation.

If the value of the currently existing technical visibility distance of the obstacle detection arrangement 22 is greater than or equal to the currently required value of the technical visibility distance for obstacle detection ($A.Sw \geq 0$), then the rail vehicle 2 can be operated at the maximum permissible speed.

If the value of the currently existing technical visibility distance of the obstacle detection arrangement 22 is less than the currently required value of the technical visibility distance for obstacle detection ($A.Sw < 0$), then the rail vehicle 2 must run more slowly. By means of the control signal StS, a restriction of the speed of the rail vehicle 2 is preferably achieved by dynamically adapting the braking curve in such a way that it is possible to stop before the obstacle 16.

In particular, the determination of the value Sw.SoII of the currently required technical visibility distance for obstacle detection as a specified minimum for the technical visibility distance (as a specified minimum for the sensory range) on the basis of the above-cited information I.Bw, I.uSw, I.tSw has a number of advantages.

The value Sw.SoII thus represents a benchmark for the required safety of the system 14, and in particular its on-board obstacle detection arrangement 22, and therefore for the eligibility thereof for certification for automatic running.

The system availability during automatic running is increased, since a dynamic braking adaptation based on a defined safety requirement allows the rail vehicle 2 to run even under poor environmental conditions and under topological conditions detrimental to sight—it is not always necessary to stop the rail vehicle.

There is no interaction with existing train control systems.

The value Sw.SoII serves as a definition of a design criterion for the sensor technology for automatic running.

The inventive method and the inventive system also offer the advantage that operational and environmental limiting conditions can be defined and their transformation can be realized by determining the target value as a specification for the performance of the obstacle detection arrangement 22 during the track observation, said specification being dynamically adapted to the given circumstances of the track and being at least as good as the performance of a locomotive driver under the same limiting conditions in this case.

The obstacle detection arrangement 22 of the rail vehicle 2 has a specific performance in respect of its visibility distance and also a specific performance in respect of its resolution, said performance corresponding to its type, the current environmental conditions, the current topological conditions, and the type of the respective obstacle.

In each case, the rail vehicle 2 dynamically adapts its driving strategy as a function of the information sI.O relating to the location of the obstacle (and therefore as a function of its distance from the obstacle), as a function of the information sI.T relating to the type of the obstacle, and as a function of the deviation of the actual value from the target value (and therefore as a function of the currently existing performance of the on-board obstacle detection arrangement 22 and the currently required performance for obstacle detection), detects and classifies the obstacle 16 more closely, and initiates the corresponding reaction, e.g. sounding the hooter or alerting a maintenance gang. In most cases, the obstacle (e.g. a large animal or a person) will have disappeared or can be chased away. In this case, the rail vehicle 2 reports the cleared status by means of a corresponding return signal RS to the communication unit of the next signal it passes.

While it would be necessary to block and clear the track after an obstacle is detected during normal operation, the inventive system 14 allows the rail vehicle 2 to run autonomously at optimum speed.

The invention claimed is:

1. A method for detecting obstacles in a hazardous area in front of a rail vehicle, the method comprising the following steps:

using an obstacle detection arrangement to detect the obstacles in the hazardous area in front of the rail vehicle;

determining a target value for a variable characterizing a performance of the obstacle detection arrangement;

providing a value corresponding to a currently required technical visibility distance for obstacle detection as the target value;

determining an actual value of the variable characterizing the performance of the obstacle detection arrangement; and providing a value corresponding to a currently existing technical visibility distance of the obstacle detection arrangement as the actual value.

2. The method according to claim 1, which further comprises generating a control signal as a function of a deviation of the actual value from the target value for adapting a driving strategy of the rail vehicle.

3. The method according to claim 1, which further comprises using an on-board obstacle detection arrangement as the obstacle detection arrangement.

4. The method according to claim 1, which further comprises determining the target value as a function of at least one of:

information relating to a current braking distance of the rail vehicle, or information relating to a given environmental visibility distance at a current location of the rail vehicle, or information relating to a given topological visibility distance at the current location of the rail vehicle.

5. The method according to claim 1, which further comprises determining the actual value as a function of information relating to a type of the obstacle detection device.

6. A method for detecting obstacles in a hazardous area in front of a rail vehicle, the method comprising the following steps:

using an obstacle detection arrangement to detect the obstacles in the hazardous area in front of the rail vehicle;

determining an actual value of the variable characterizing the performance of the obstacle detection arrangement;

providing a value corresponding to a currently existing technical resolution of the obstacle detection arrangement as the actual value;

determining a target value for a variable characterizing a performance of the obstacle detection arrangement; and providing a value corresponding to a currently required technical resolution for obstacle detection as the target value.

7. A system for detecting obstacles in a hazardous area in front of a rail vehicle, the system comprising:

an obstacle detection arrangement for detecting the obstacles in the hazardous area in front of the rail vehicle;

the system being configured to determine a target value for a variable characterizing a performance of said obstacle detection arrangement;

the system being configured to determine an actual value of the variable characterizing the performance of said obstacle detection arrangement; and the system being configured to provide a value corresponding to a currently existing technical visibility distance of said obstacle detection arrangement as the actual value, and a value corresponding to a currently required technical visibility distance for obstacle detection as the target value.

8. The system according to claim 7, wherein the system is configured to generate a control signal as a function of a deviation of the actual value from the target value for adapting a driving strategy of the rail vehicle.

9. The system according to claim 7, wherein said obstacle detection arrangement is an on-board obstacle detection arrangement.

10. The system according to claim 7, wherein the system is configured to determine the target value as a function of:

information relating to a current braking distance of the rail vehicle, or information relating to a given environmental visibility distance at a current location of the rail vehicle, or information relating to a given topological visibility distance at the current location of the rail vehicle.

11. The system according to claim 7, wherein the system is configured to determine the actual value as a function of information relating to a type of said obstacle detection device.

12. A system for detecting obstacles in a hazardous area in front of a rail vehicle, the system comprising:

an obstacle detection arrangement for detecting the obstacles in the hazardous area in front of the rail vehicle;

the system being configured to determine a target value for a variable characterizing a performance of said obstacle detection arrangement;

the system being configured to determine an actual value of the variable characterizing the performance of said obstacle detection arrangement; and the system being configured to provide a value corresponding to a currently existing technical resolution of said obstacle detection arrangement as the actual value, and a value corresponding to a currently required technical resolution for obstacle detection as the target value.

* * * * *